US010685527B2

(12) United States Patent
Lucker et al.

(10) Patent No.: US 10,685,527 B2
(45) **Date of Patent: *Jun. 16, 2020**

(54) BEVERAGE DISPENSER

(71) Applicant: GRUPO GALLEGOS, Huntington Beach, CA (US)

(72) Inventors: Paul Lucker, Laguna Niguel, CA (US); Domingo Chozas, Venice, CA (US); Saul Escobar, Mexico City (MX)

(73) Assignee: Grupo Gallegos, Huntington Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/519,452

(22) Filed: Jul. 23, 2019

(65) Prior Publication Data

US 2019/0347891 A1 Nov. 14, 2019

Related U.S. Application Data

(63) Continuation of application No. 15/617,519, filed on Jun. 8, 2017, now Pat. No. 10,438,438.

(60) Provisional application No. 62/347,264, filed on Jun. 8, 2016.

(51) Int. Cl.

| | |
|---|---|
| ***G07F 13/10*** | (2006.01) |
| ***F25D 3/06*** | (2006.01) |
| ***G07F 9/10*** | (2006.01) |
| ***G07F 17/00*** | (2006.01) |
| ***B65D 83/04*** | (2006.01) |
| ***F25D 31/00*** | (2006.01) |

(52) U.S. Cl.

CPC ..... *G07F 9/105* (2013.01); *B65D 83/0409* (2013.01); *F25D 3/06* (2013.01); *F25D 31/007* (2013.01); *G07F 13/10* (2013.01); *G07F 17/0071* (2013.01); *F25D 2303/08222* (2013.01); *F25D 2331/805* (2013.01)

(58) Field of Classification Search

USPC ... 221/150 R, 1, 176, 31, 24, 192, 261, 307, 221/235

See application file for complete search history.

(56) References Cited

U.S. PATENT DOCUMENTS

| | | | |
|---|---|---|---|
| 1,789,300 | A | 1/1931 | Bihl et al. |
| 1,846,941 | A | 2/1932 | Bihl et al. |
| 2,576,874 | A | 11/1951 | Acton |
| 4,042,142 | A | 8/1977 | Ruano |
| 5,009,329 | A | 4/1991 | Farrentine |
| 6,112,943 | A | 9/2000 | Lauer |
| 6,173,582 | B1 | 1/2001 | Hixson |
| 6,862,896 | B1 | 3/2005 | Seidl |
| 7,766,145 | B1 | 8/2010 | Chang |
| 8,561,422 | B2 | 10/2013 | Jackman |
| 2007/0107459 | A1 | 5/2007 | Strickland et al. |

(Continued)

OTHER PUBLICATIONS

International Searching Authority, International Search Report and Written Opinion, International Application No. PCT/US2017/036523, dated Oct. 18, 2017, pp. 1-14.

*Primary Examiner* — Gene O Crawford
*Assistant Examiner* — Ayodeji T Ojofeitimi
(74) *Attorney, Agent, or Firm* — Hunton Andrews Kurth LLP

(57) ABSTRACT

A beverage dispenser for dispensing beverage containers includes an outer shell with an internal track that dispenses rolling beverage containers from the track and one or more internal ice liners that retain ice to keep the beverage containers chilled.

18 Claims, 19 Drawing Sheets

(56) References Cited

U.S. PATENT DOCUMENTS

| | | | |
|---|---|---|---|
| 2011/0011099 | A1 | 1/2011 | Linder |
| 2011/0101015 | A1 | 5/2011 | Bollmus et al. |
| 2011/0181792 | A1 | 7/2011 | Hammonds |

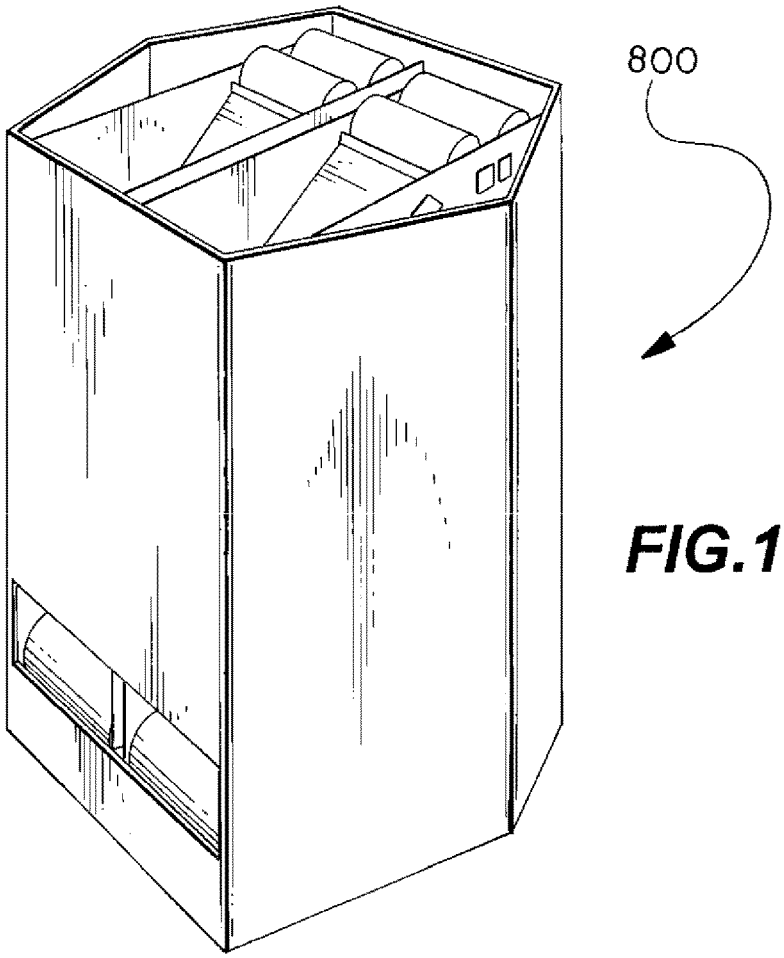
FIG.12A
FIG.12B
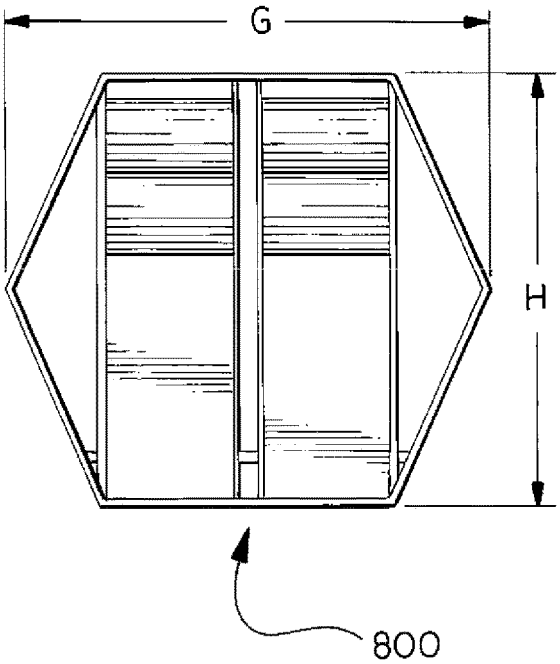
FIG.12C
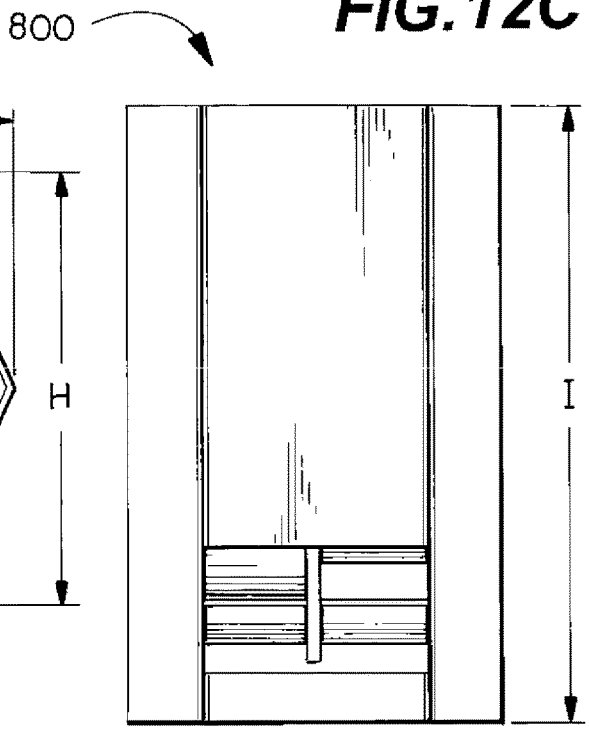

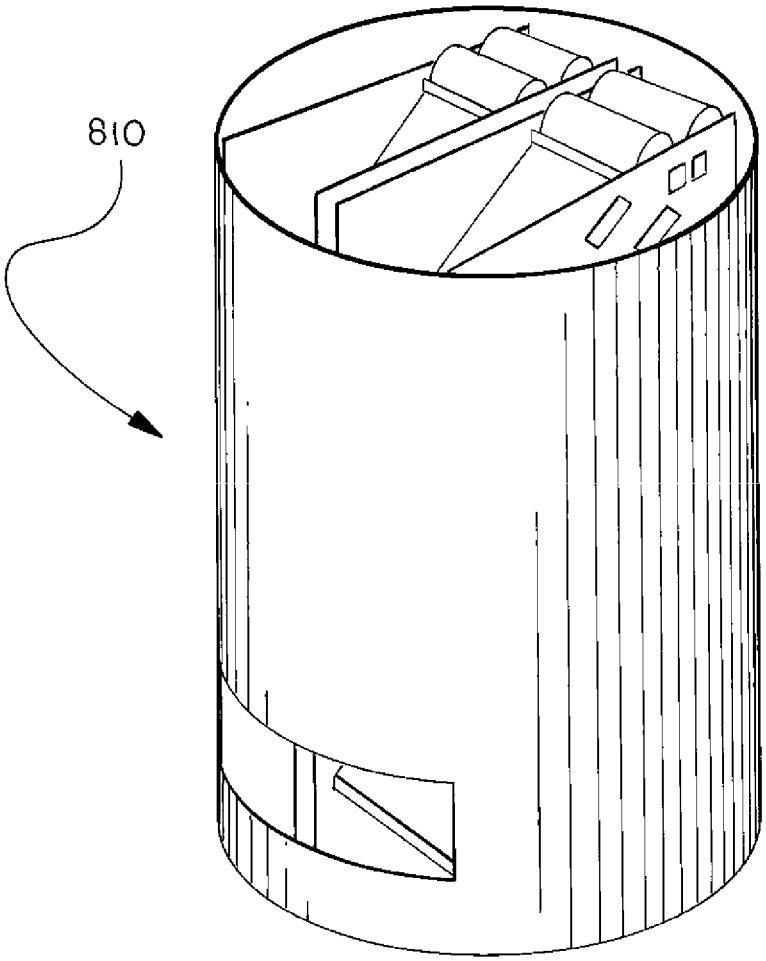
FIG.13A
FIG.13B
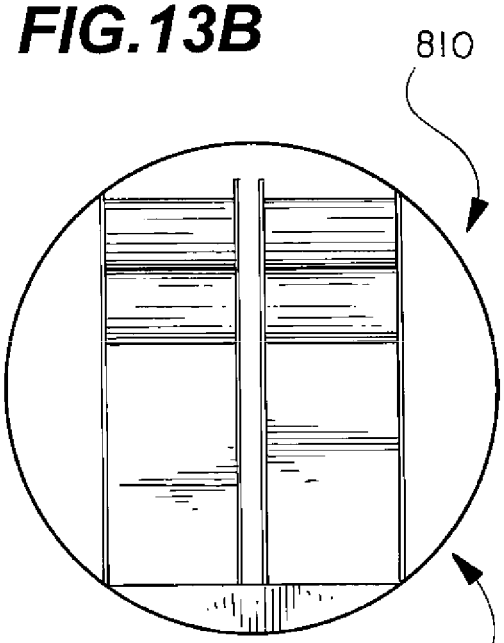
FIG.13C
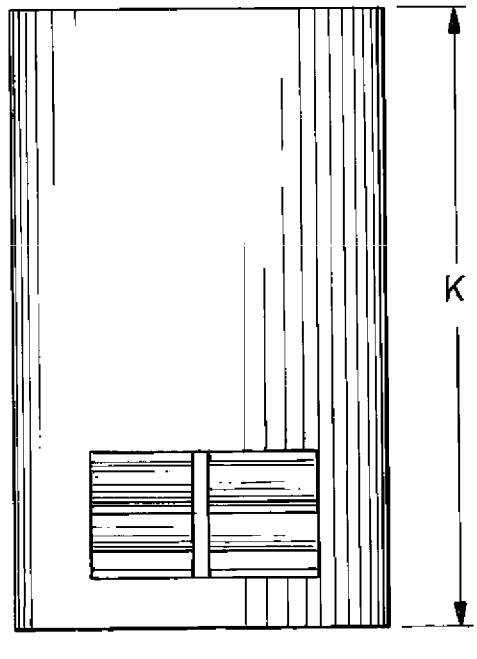

BEVERAGE DISPENSER

CROSS-REFERENCE TO RELATED APPLICATIONS

This application is a continuation of U.S. application Ser. No. 15/617,519, filed on Jun. 8, 2017, which claims the benefit of U.S. Provisional Application No. 62/347,264, filed Jun. 8, 2016, the content of which are both incorporated herein by reference.

BACKGROUND OF THE INVENTION

The present invention relates to a dispenser for beverages in containers, such as in cans and bottles. Conventional dispensers such as vending machines typically require electrical power for refrigeration and coolers require users to open, find and retrieve a beverage from storage, such as from ice. There is a need for an easy-to-use and easy-to-set-up dispenser that can both keep beverages chilled while individually dispensing a canned (or bottled) beverage to a user.

SUMMARY OF THE INVENTION

The present invention provides a dispenser for cans (or bottles in other embodiments), such as beer cans, that includes a space to be filled with ice and an internal track ramp that holds a desired number of cans (e.g. 60 cans). The track ramp is inclined and descends to a dispensing slot at the bottom of the dispenser, and gravity causes a new can to move to the slot as gravity pulls the cans to roll down the ramp when a can is removed.

In embodiments a dispenser of the invention may be constructed of styrene or metal. In other embodiments the dispenser may be constructed of plastics, polymers and other materials. The dispenser may be assembled by end user from product components or may be pre-assembled for use by an end user. In some embodiments a dispenser of the invention may be loaded, and re-loaded, with beverages, such as canned beverages, by the user. In other embodiments, a pre-assembled dispenser of the invention may include beverages, such as canned beverages, pre-loaded (i.e. pre-packaged, such as from 24 to 60 beverage cans, and preferably about thirty-six (36) to forty-eight (48) twelve ounce beverage cans) in the dispenser when it is purchased or otherwise obtained by a user for dispensing beverages.

In further embodiments a dispenser of the present invention may be provided in a beer keg-type shape, and may include handles for transporting the dispenser.

In some embodiments, beverage containers may be dispensed near a bottom dispensing hole of the dispenser. In other embodiments, a plunger may be used to pull up a beverage container from a bottom area of the dispenser to the top of the dispenser into a top dispensing location.

BRIEF DESCRIPTION OF THE DRAWINGS

FIG. 12A is a perspective view of a beverage dispenser having a 4-track assembly and a hexagonal outer shell in a 48-can embodiment of the present invention.

FIG. 12B is a top plan view of a beverage dispenser having a 4-track assembly and a hexagonal outer shell in a 48-can embodiment of the present invention.

FIG. 12C is a front plan view of a beverage dispenser having a 4-track assembly and a hexagonal outer shell in a 48-can embodiment of the present invention.

FIG. 13A is a perspective view of a beverage dispenser having a 4-track assembly and a round outer shell in a 48-can embodiment of the present invention.

FIG. 13B is a top plan view of a beverage dispenser having a 4-track assembly and a round outer shell in a 48-can embodiment of the present invention.

FIG. 13C is a front plan view of a beverage dispenser having a 4-track assembly and a round outer shell in a 48-can embodiment of the present invention.

DETAILED DESCRIPTION OF THE INVENTION

Figure 1A:
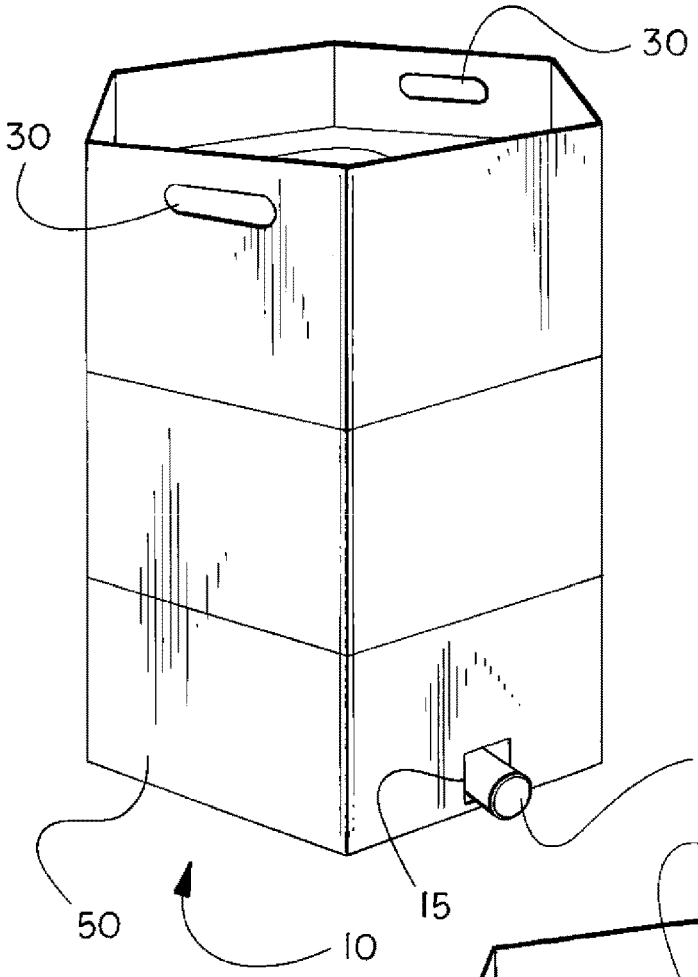
FIG. 1A is a perspective view of a beverage dispenser in an embodiment of the present invention.
Figure 1B:
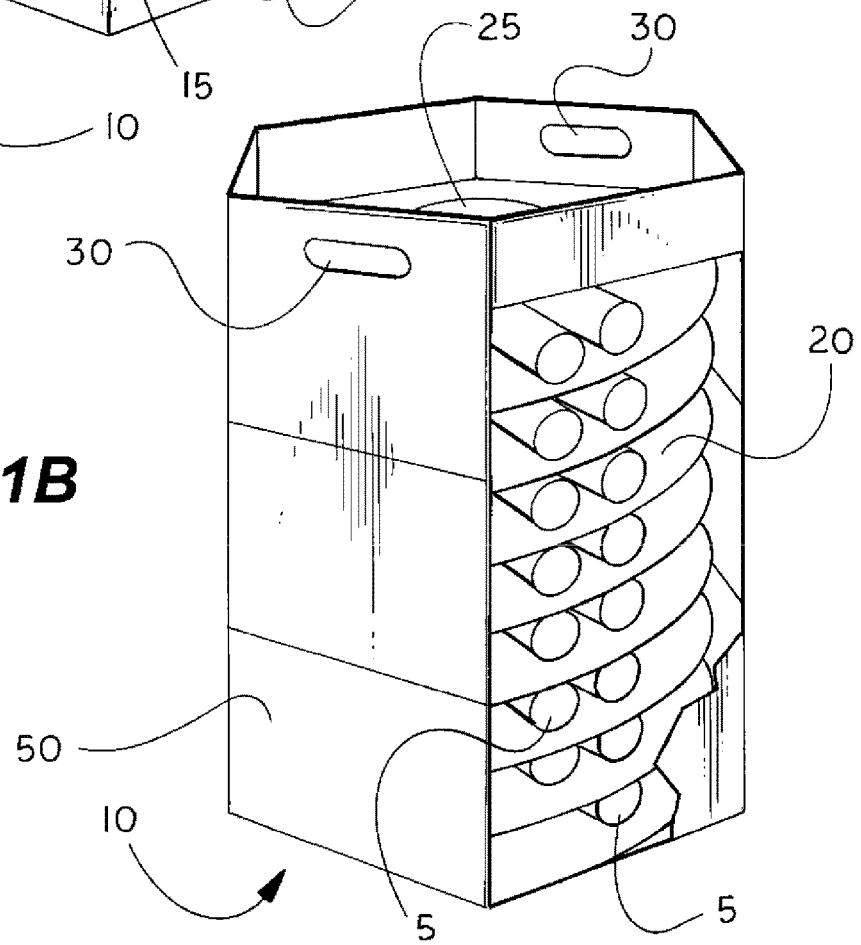
FIG. 1B is a partial cutaway perspective view of a beverage dispenser in an embodiment of the present invention.

Referring to FIGS. 1A and 1B, in one embodiment of the invention, a beverage dispenser 10 has outer shell 50 with walls that provide a beer keg-type outer shape. Inside the outer shell 50, a spiral, ramp or similar descending and inclined track assembly 20 winds around a hollow space 25 from the top of the dispenser to a dispensing slot 15 at a lower location (such as near the bottom) of the dispenser. Beverages in beverage containers 5, such as beer cans (but may include bottles and non-limiting choice of beverages, such as beer, soft drinks, juices, water and the like, and non-limiting materials from which the beverage containers 5 are made such as metal, plastic, glass and the like), are arranged on the track assembly 20 so that gravity acts to cause the beverage containers 5 to move toward the dispensing slot 15 along the track assembly 20 as each beverage container 5 is removed from the slot 15. In the depicted embodiment, the dispenser 10 includes handles 30 and dispenser components may be constructed of a variety of suitable materials known in the art (including for example styrene, metals, plastics, foamed products, polymers and others) and may be pre-packaged to include beverage containers 5 as sold or otherwise provided to a user for use in the dispenser 10. It will also be appreciated that a dispenser 10 of the invention may also be loaded or re-loaded with beverage containers 5 by a user, including, for example, a wall of the dispenser 10 being hinged or detached for placement of beverage containers 5, a loading hole provided near a top of the dispenser 10 and adjacent to an upper portion of the track assembly 20 to insert beverage containers 5, and turning the dispenser 10 upside down to load it from the dispensing slot 15 and then returning the dispenser 10 to a "right-side" up position with the dispensing slot 15 at or near a bottom surface of the dispenser 10.

In embodiments of the invention, the hollow space 25 of the dispenser 10 is filled with ice, ice packs and the like, to chill the beverages on the ramp that are adjacent to the ice-retaining space. In one depicted embodiment, the hollow space may be provided as single-central ice holding space around which the track assembly 20 wraps. In some embodiments a cap or cover is provided to cover an opening of the ice-holding space 25. In further embodiments, the ice-holding space 25 may be constructed of, or include a liner of, water-resistant material to resist and limit the effects of water and melting ice on the dispenser components.

Figure 2:
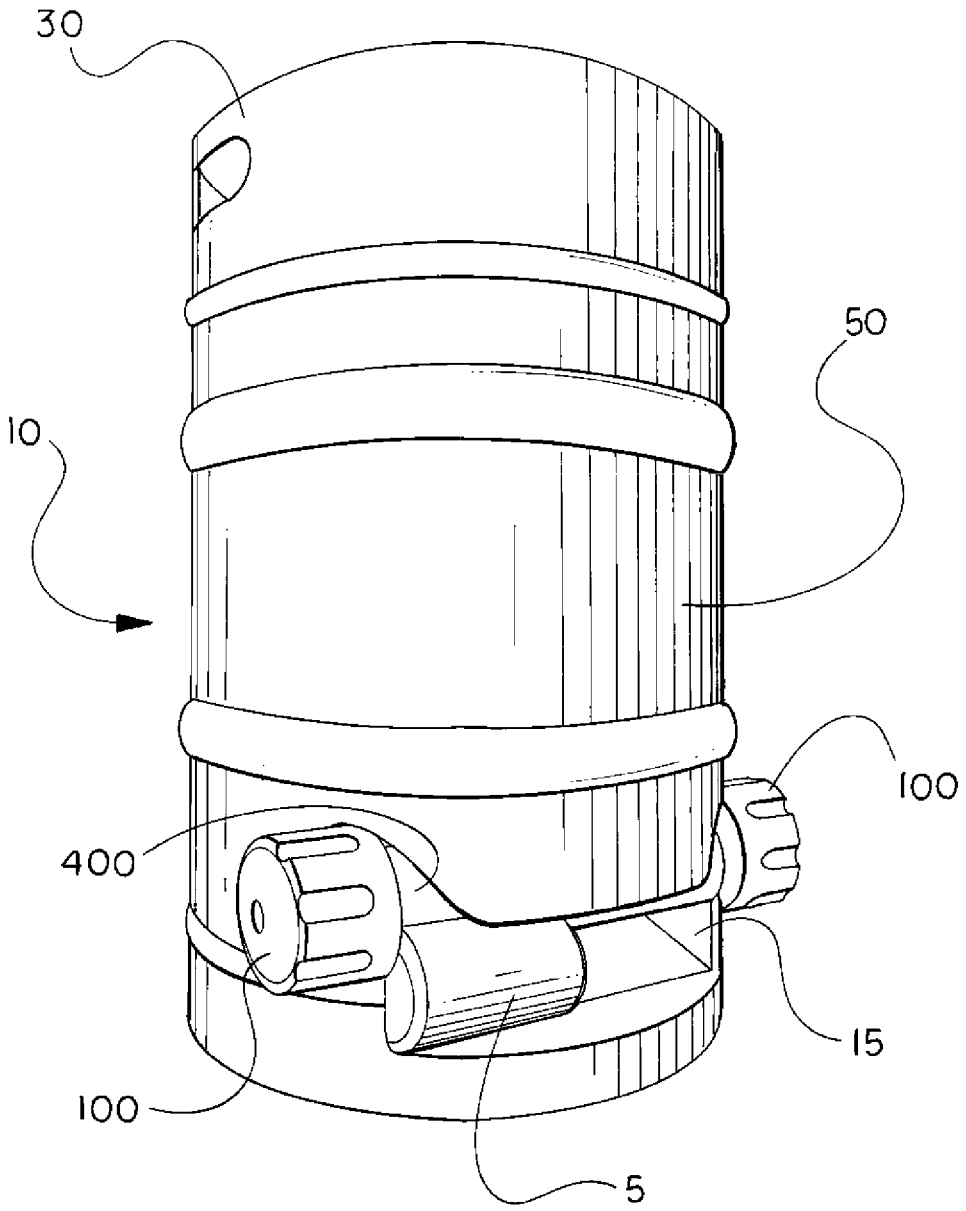
FIG. 2 is a perspective view of a beverage dispenser having a dual track assembly in a 36-can embodiment of the present invention.
Figure 4:
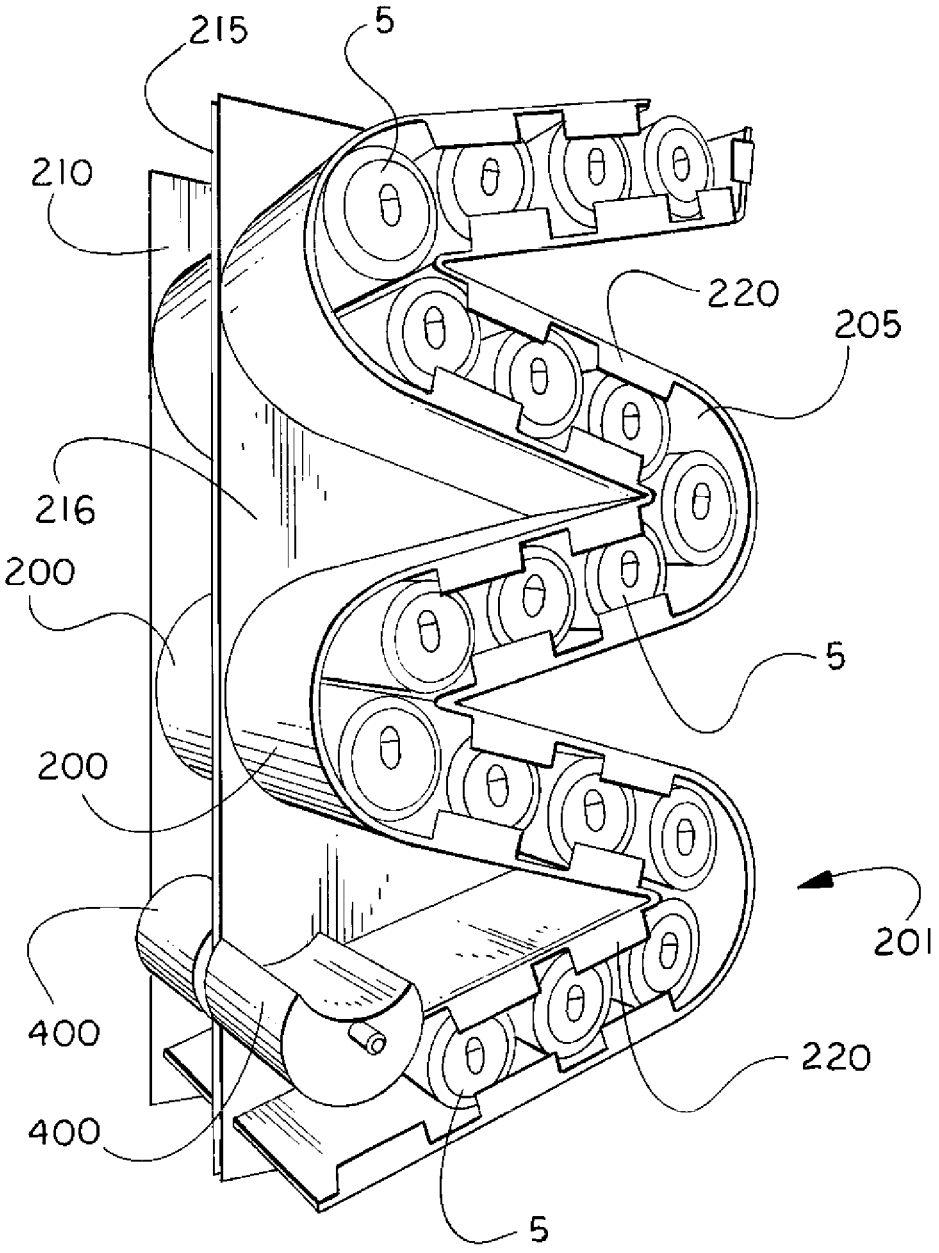
FIG. 4 is a perspective view of a dual track assembly of a beverage dispenser in a 36-can embodiment of the present invention.

Referring to FIG. 2, a beverage dispenser 10 having an internal dual track assembly 20 is shown in a 36-can embodiment of the present invention. In this embodiment two tracks are provided for beverage containers 5 to be dispensed at the dispensing slot 15 with rollers 100 connected to one or more escapement holders 400 (FIG. 4). As a roller 100 is turned, a beverage container 5 is moved until it reaches an open position at the dispensing slot 15. In the depicted dual track embodiment, beverage containers 5 are dispensed side-by-side according to the construction of the escapement holders 400. In this depicted embodiment, one escapement holder 400 holds a beverage container 5 for next release by turning roller 100, wherein beverage containers 5 may be alternately dispensed on one side (from the first track) and then the other side (from the second track). In other embodiments, containers 5 may be dispensed together in a simultaneous manner depending on construction of the escapement holder 400 or multiple escapement holders 400.

Figure 3A:
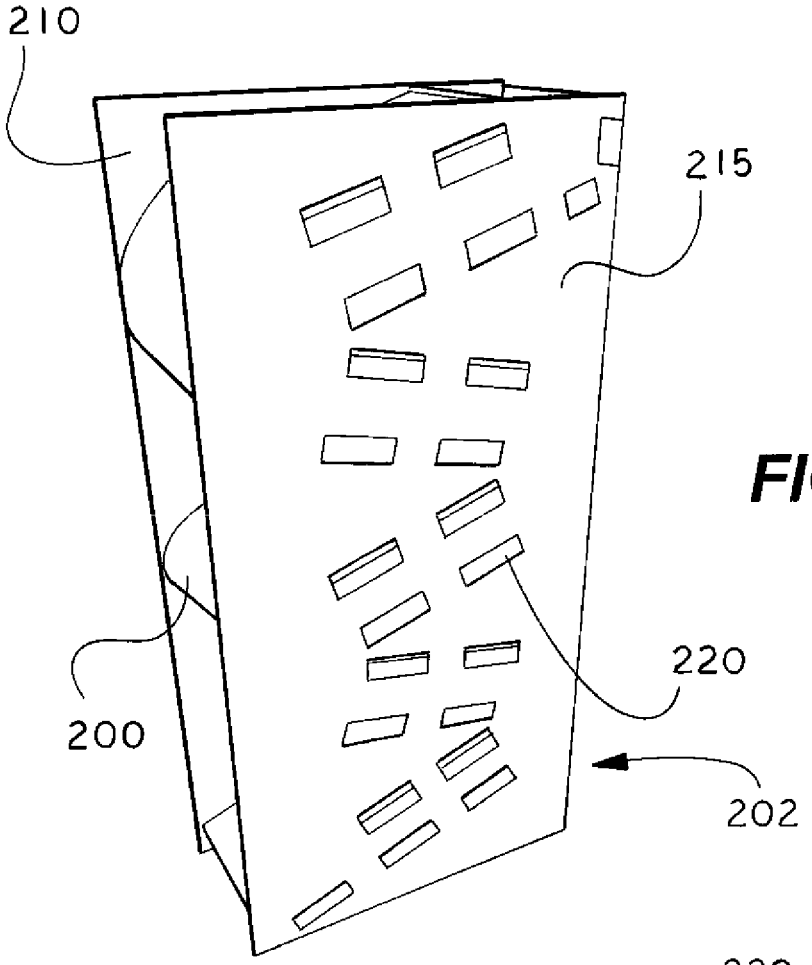
FIG. 3A is a perspective view of a track assembly of a beverage dispenser in a 36-can embodiment of the present invention.
Figure 3B:
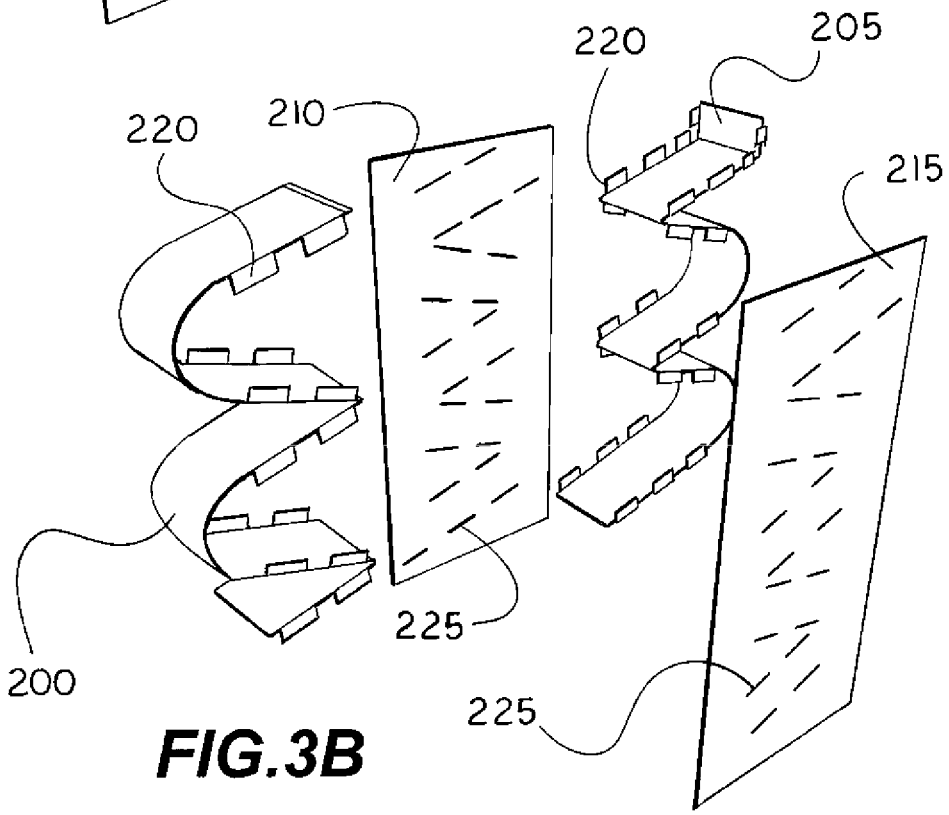
FIG. 3B is an exploded view of a track assembly of a beverage dispenser in a 36-can embodiment of the present invention.

Referring to FIGS. 3A and 3B, a track assembly 202 is shown to include a first side wall 210 and second side wall 215. Between side walls 210 and 215 are positioned a first track ramp 200 and complementary second track ramp 205. In the depicted embodiment, the track ramps 200 and 205 include tabs 220 that fit into tab slots 225 of the side walls 210 and 215. The tabs 220 may fold to hold the track ramps 200 and 205 in the desired configuration.

Referring to FIG. 4, a dual track assembly 201 that includes 2 track assemblies 202 as shown in FIGS. 3A and 3B is shown for a beverage dispenser 10 in a 36-can embodiment of the present invention.

Figure 5A:
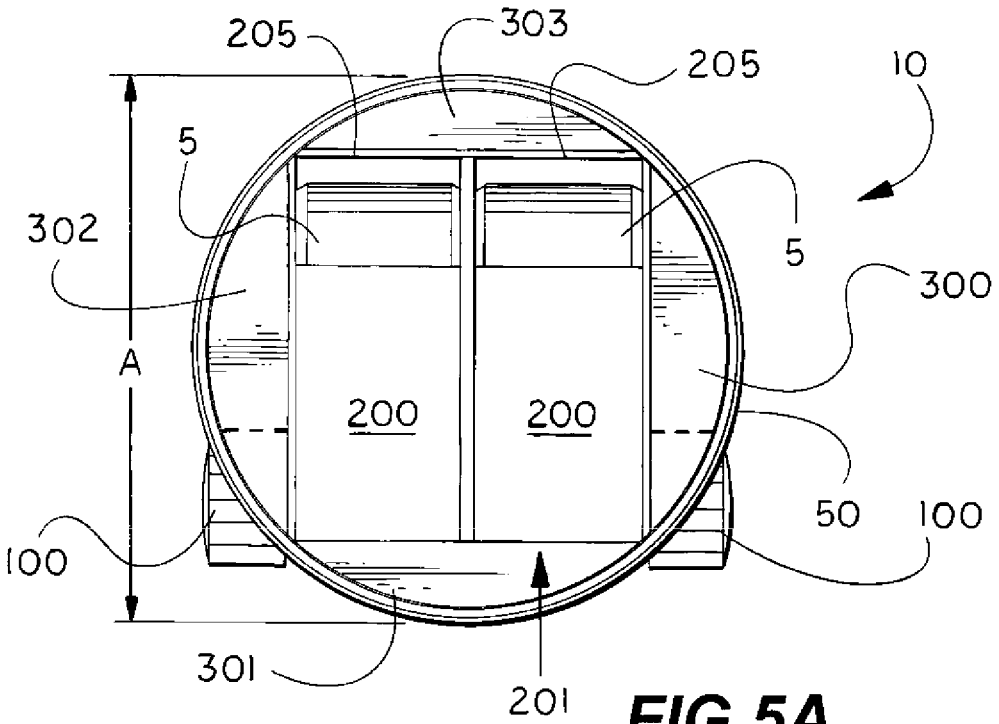
FIG. 5A is a top plan view of a beverage dispenser having a dual track assembly in a 36-can embodiment of the present invention.
Figure 5B:
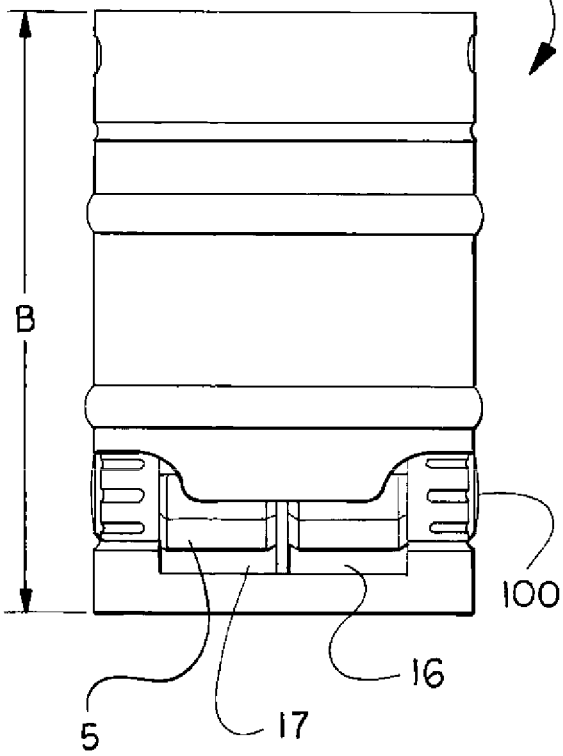
FIG. 5B is a front plan view of a beverage dispenser having a dual track assembly in a 36-can embodiment of the present invention.
Figure 5C:
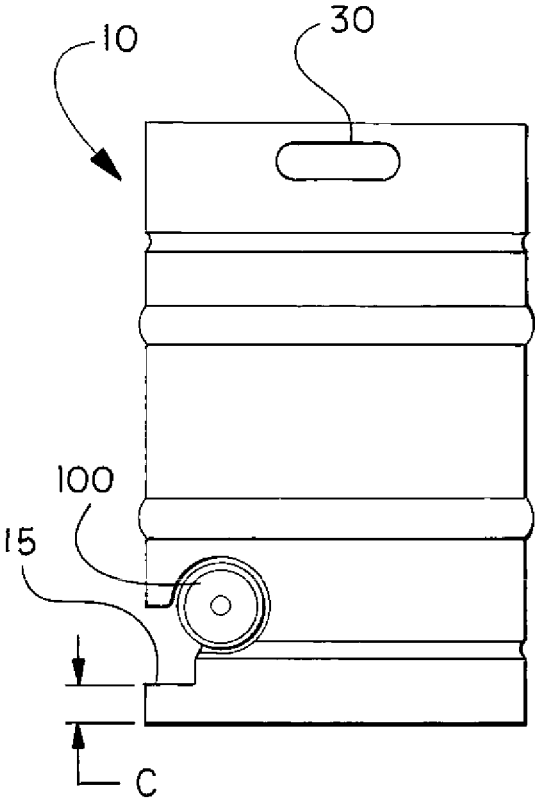
FIG. 5C is a side plan view of a beverage dispenser having a dual track assembly in a 36-can embodiment of the present invention.

Referring to FIGS. 5A-5C, a beverage dispenser 10 having a dual track assembly 201 in a 36-can embodiment of the present invention is shown. In such embodiment, four ice liner openings 300, 301, 302 and 303 surround the dual track assembly 201. Ice may be provided into each ice liner opening to keep the beverage containers 5 on the dual track assembly 201 cold. As shown in FIG. 5B, dispensing slot 15 may include two dispensing areas 16 and 17, each corresponding to a track, such as shown side-by-side. In one embodiment of FIGS. 5A-5C, dispenser 10 may include the following dimensions: (A) diameter of 16.13 inches, (B) height of 24.88 inches, and (C) dispenser slot base height from ground of 1.55 inches. It will be appreciated that such dimensions are non-limiting, and a dispenser 10 may be constructed with other dimensions.

Figure 6:
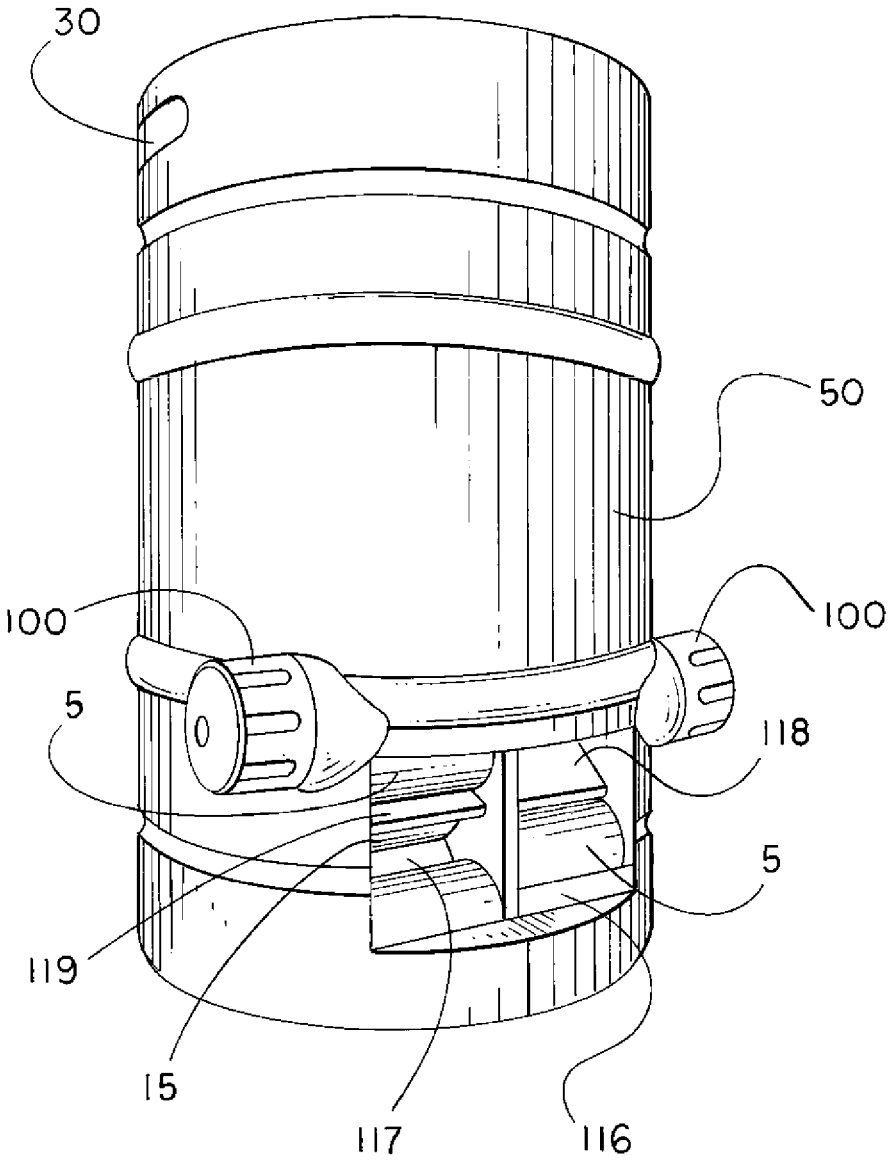
FIG. 6 is a perspective view of a beverage dispenser in a 48-can embodiment of the present invention.
Figure 7:
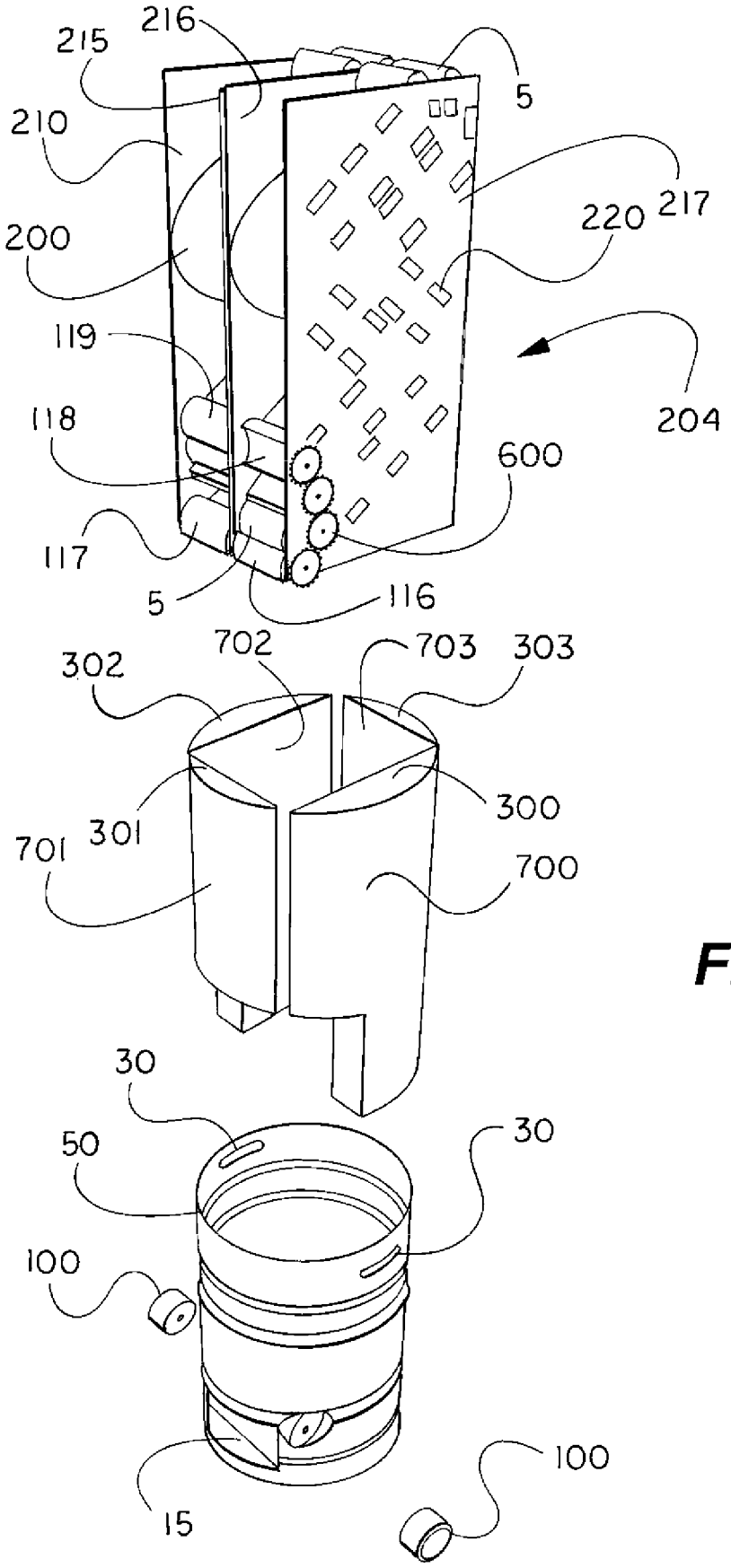
FIG. 7 is an exploded view of a 4-track assembly, ice liners, outer shell and roller mechanism of a beverage dispenser in a 48-can embodiment of the present invention.
Figure 8:
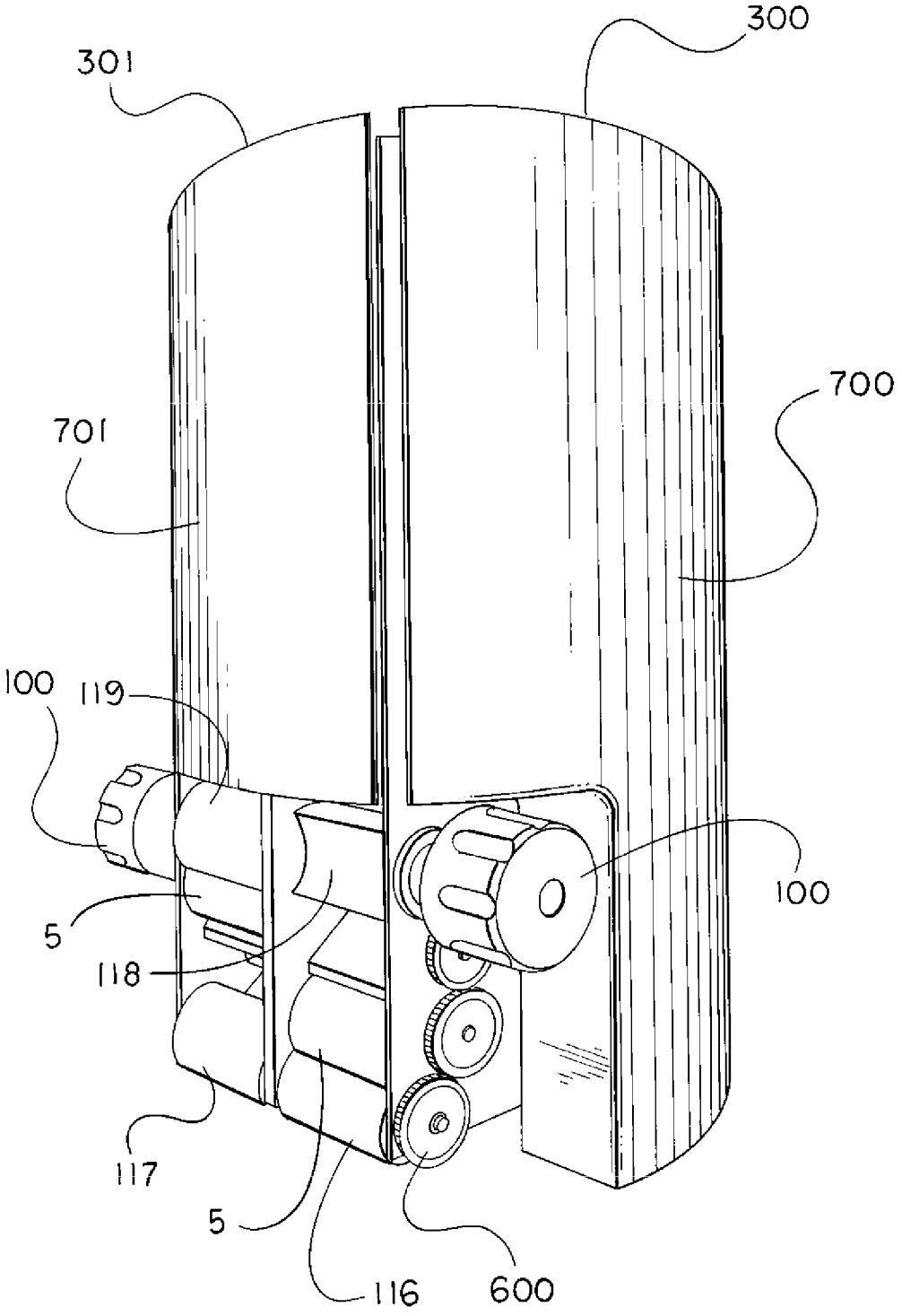
FIG. 8 is a perspective view of a 4-track assembly, ice liners, and roller mechanism of a beverage dispenser in a 48-can embodiment of the present invention.
Figure 9A:
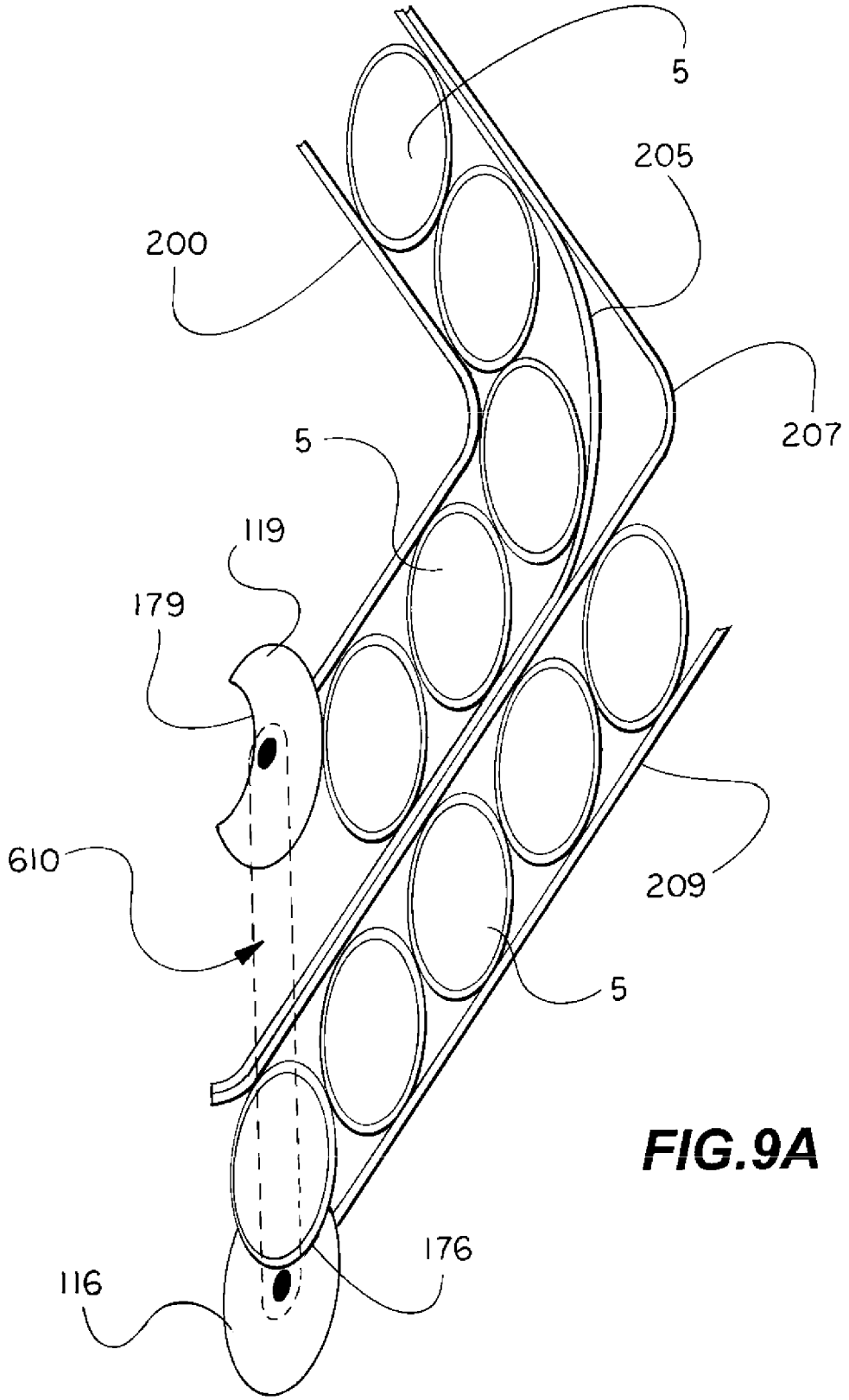
FIG. 9A is a schematic illustration of a multi-option escapement roller mechanism for a beverage dispenser having a 4-track assembly in a 48-can embodiment of the present invention.
Figure 10:
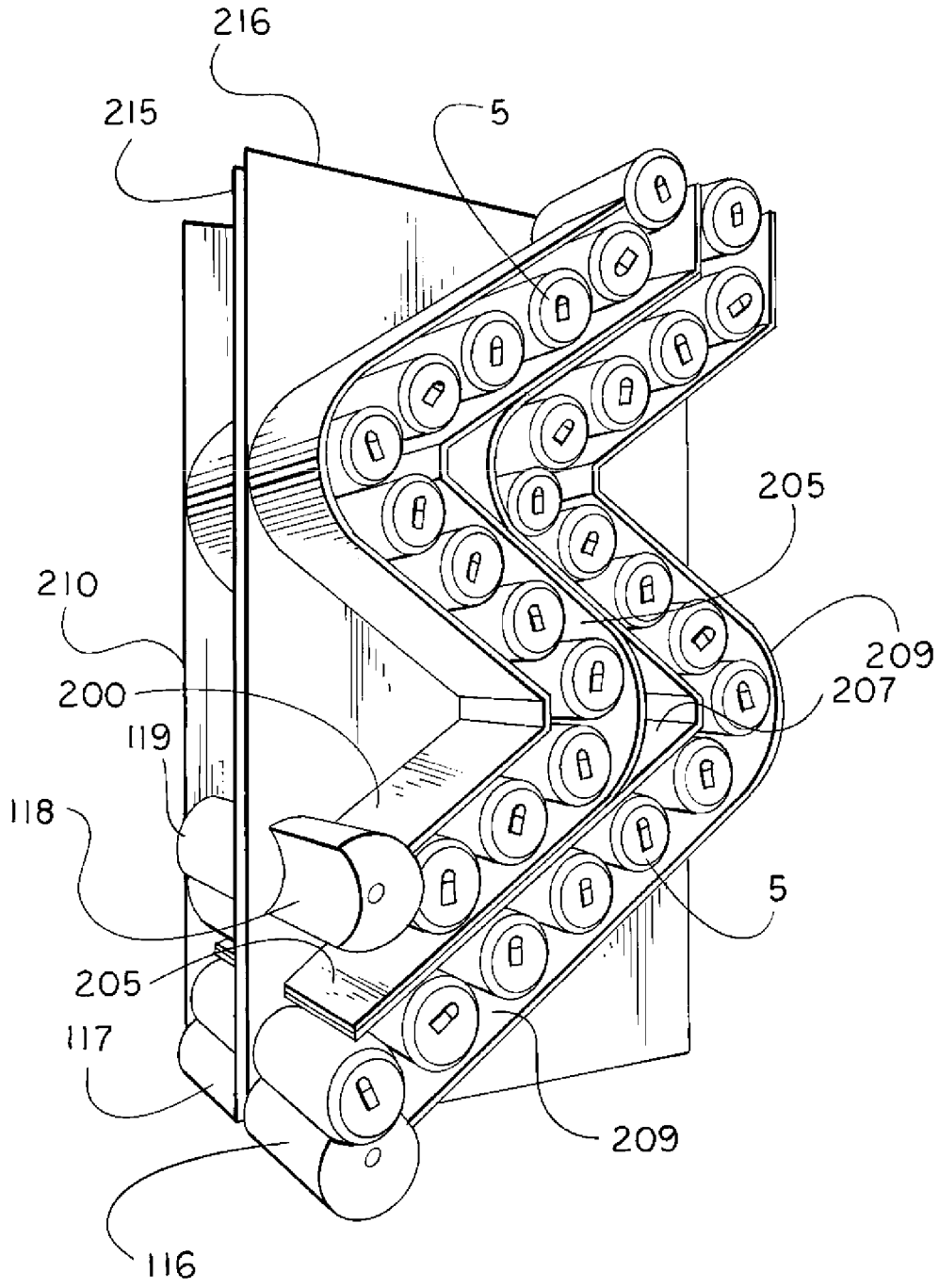
FIG. 10 is a perspective view of a 4-track assembly of a beverage dispenser in a 48-can embodiment of the present invention.

Referring to FIG. 6, a beverage dispenser 10 in a 48-can embodiment of the present invention is shown. With further reference to FIGS. 7 and 8, the depicted 48-can embodiment includes a 4-track assembly 204 with four dispenser escapement holders 116, 117, 118 and 119. The 4-track assembly 204 provides four tracks made up of a pair of four track ramps 200, 205, 207 and 209, as shown in FIGS. 9A and 10, that provide two track ramps in a side-by-side configuration (for a total of four tracks or track ramps). The tracks are connected between respective pairs of side walls 210 and 215 and 216 and 217 (FIGS. 7 and 10).

With continuing reference to FIGS. 7 and 8, a 48-can embodiment of the present invention with a 4-track assembly 204 includes four ice liners 700, 701, 702 and 703 with corresponding ice liner openings 300, 301, 302 and 303. The ice liners hold ice and melted water.

Figure 9B:
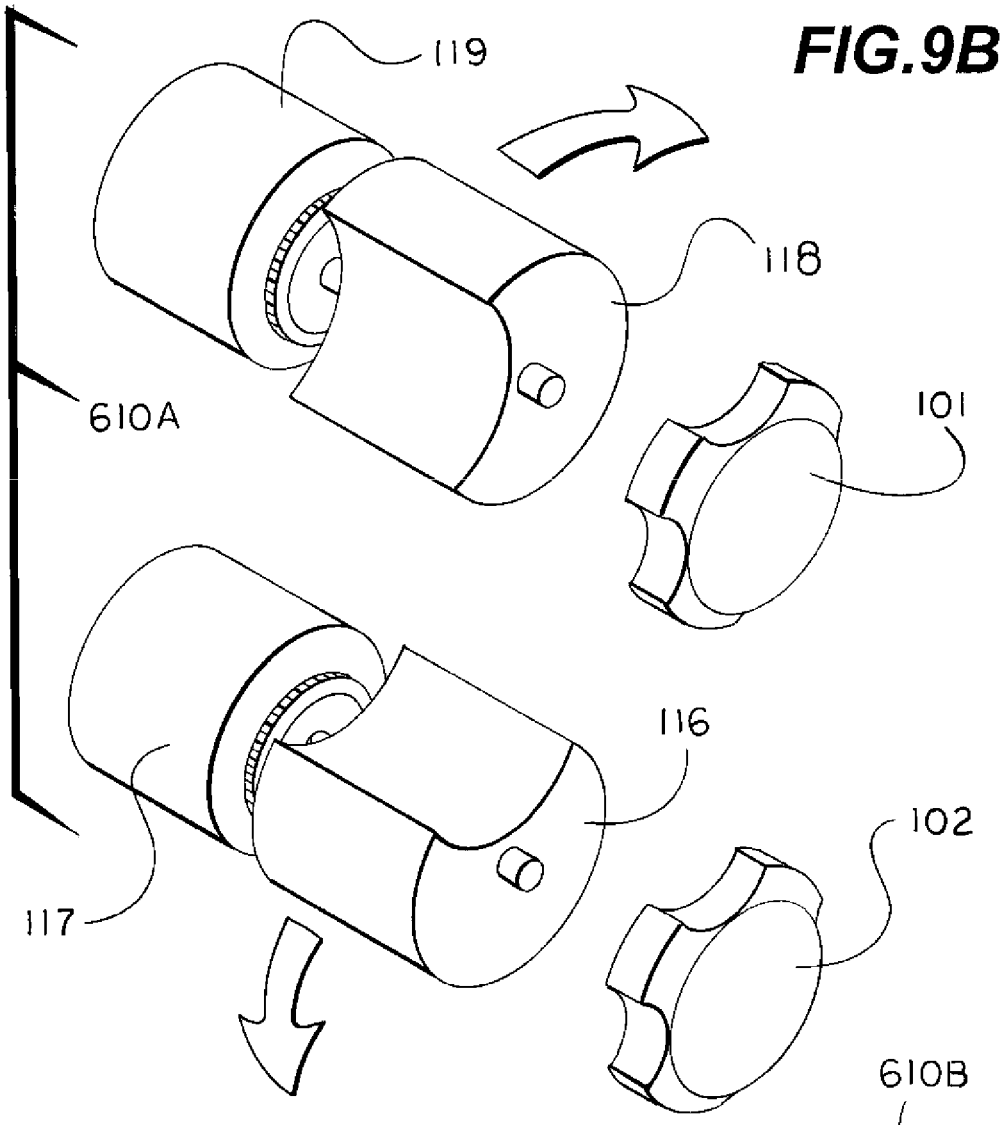
FIG. 9B is a schematic illustration for a first option of the multi-option escapement roller mechanism of FIG. 9A that includes an individual hand-operated upper roller and an individual hand-operated lower roller for a beverage dispenser having a 4-track assembly in a 48-can embodiment of the present invention.
Figure 9C:
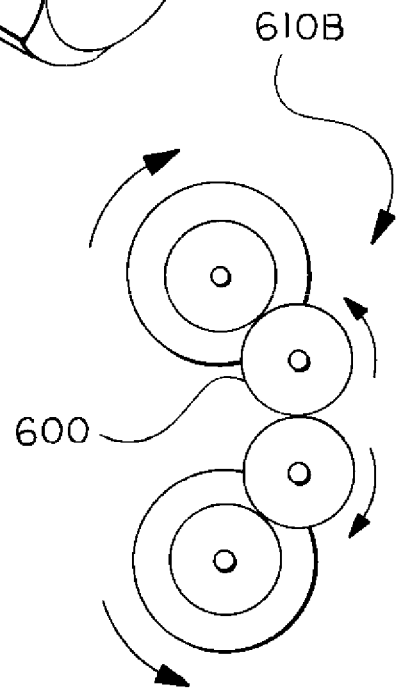
FIG. 9C is a schematic illustration for a second option of the multi-option escapement roller mechanism of FIG. 9A that includes an upper roller and a lower roller joined by a gear system for a beverage dispenser having a 4-track assembly in a 48-can embodiment of the present invention.

With further reference to FIGS. 9A, 9B and 9C, dispensing of beverage containers 5 from a 4-track assembly 204, a multi-option mechanism 610 (FIG. 9A), i.e. either of the options of FIGS. 9B and 9C may alternatively be utilized, for operation the four escapement holders 116, 117, 118 and 119 to dispense containers 5.

A first option 610A shown in FIG. 9B depicts an upper roller 101 connected to escapement holders 118 and 199 and lower roller 102 connected to escapement holders 116 and 117. As to option 610A, each roller 101 and 102 may be individually operated by hand twists of the corresponding roller. It will be appreciated that the recessed holding area of each escapement holder retains a beverage container 5 to be dispensed when the container 5 and holding area reach the opening of the corresponding dispensing slot.

A second option 610B shown in FIG. 9C depicts a system of gears 600 connecting an upper roller 101 and lower roller 102. Each 90 degree turn of a knob releases a container 5 from one of the escapement holders 116, 117, 118 and 119.

Figure 11A:
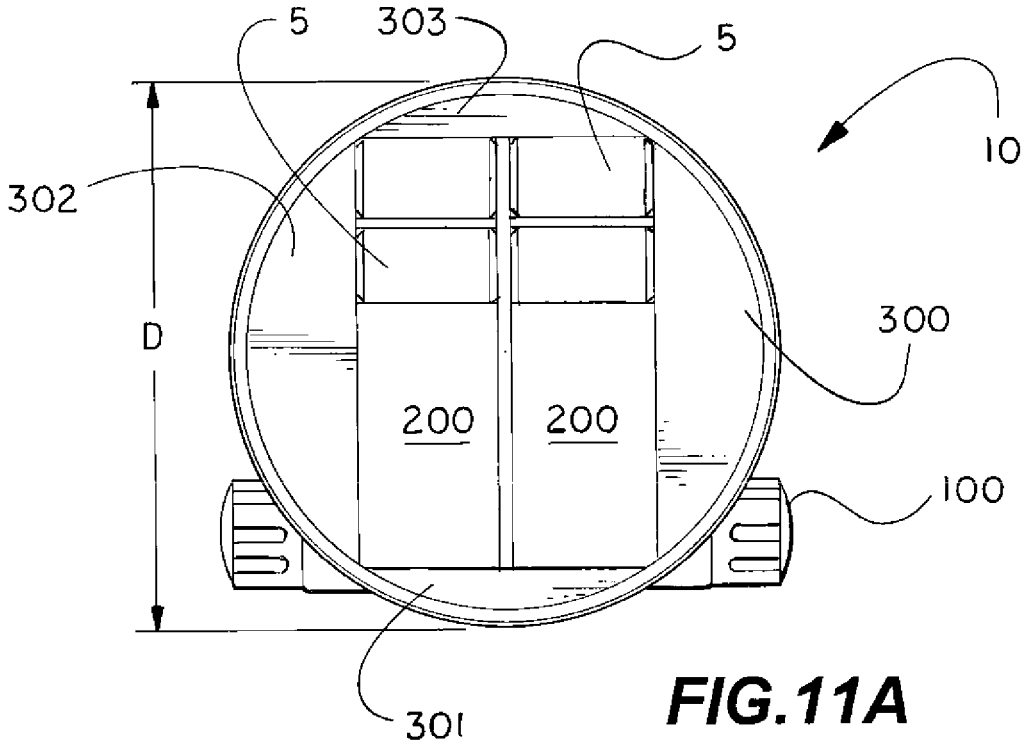
FIG. 11A is a top plan view of a beverage dispenser having a 4-track assembly in a 48-can embodiment of the present invention.
Figures 11B, 11C:
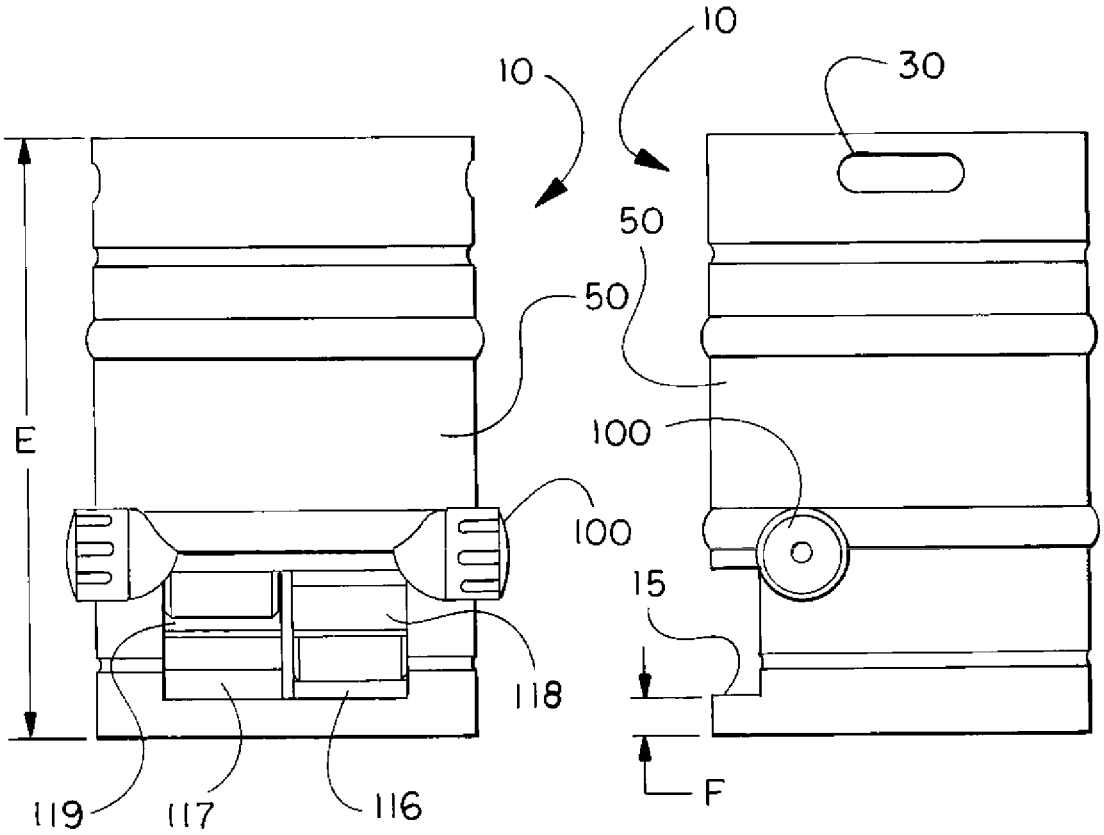
FIG. 11B is a front plan view of a beverage dispenser having a 4-track assembly in a 48-can embodiment of the present invention.
FIG. 11C is a side plan view of a beverage dispenser having a 4-track assembly in a 48-can embodiment of the present invention.
Figure 14:
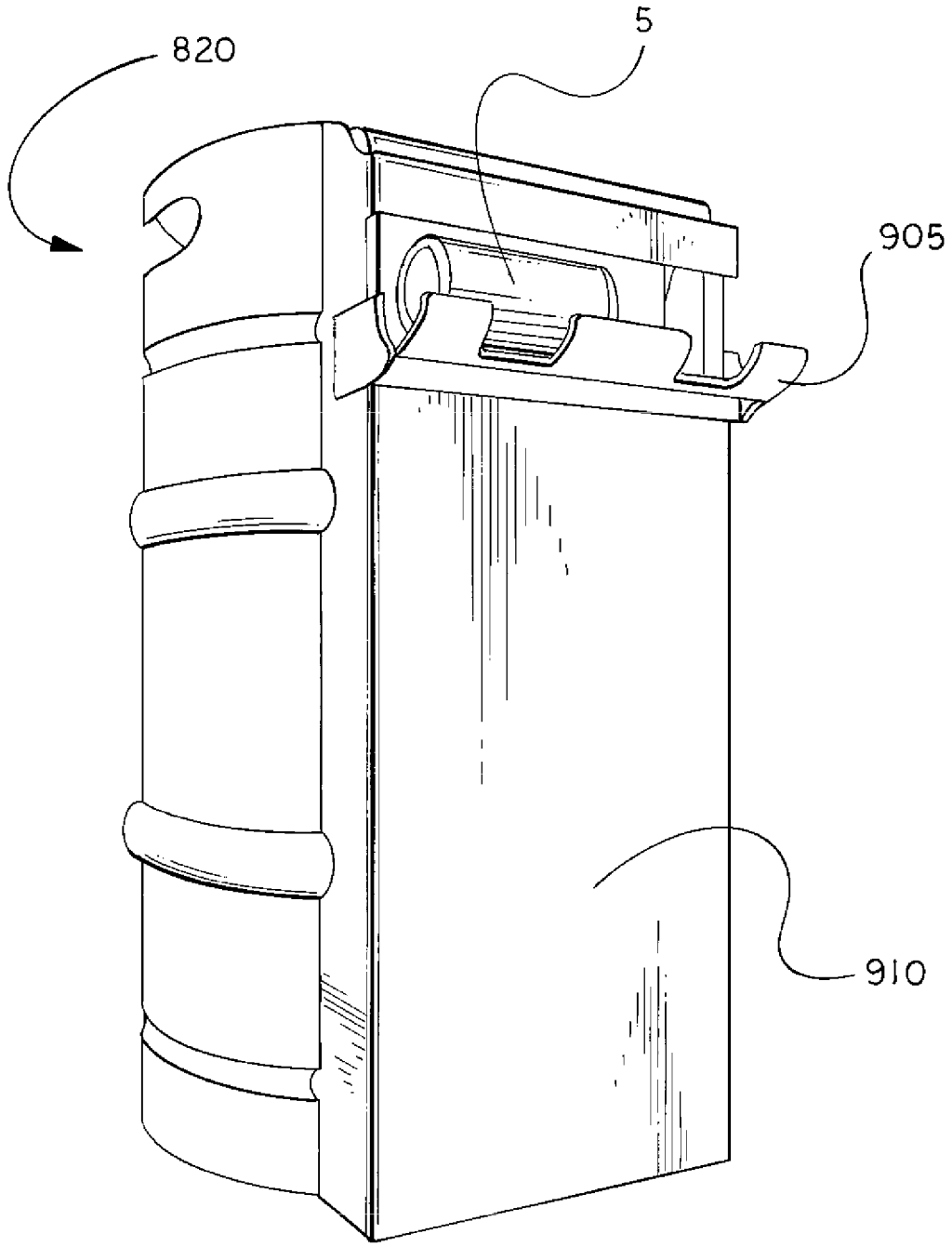
FIG. 14 is a perspective view of a beverage dispenser in a top unload embodiment of the present invention.

Referring to FIGS. 11A-11C, a beverage dispenser 10 having a 4-track assembly 204 in a 48-can embodiment of the present invention is shown. In such embodiment, four ice liner openings 300, 301, 302 and 303 surround the dual track assembly 204. Ice may be provided into each ice liner opening to keep the beverage containers 5 on 4-track assembly 204 cold. As shown in FIG. 11B, dispensing escapements 116, 117, 118 and 119 of dispenser slot 15, each correspond to a track, may be provided side-by-side with two upper and two lower dispensing areas. Such configuration permits up to 4 containers 5 to be dispensed from the 4 tracks. In one embodiment of FIGS. 11A-11C, dispenser 10 may include the following dimensions: (D) diameter of 19.25 inches, (E) height of 29.50 inches, and (F) dispenser slot base height from ground of 2.50 inches. It will be appreciated that such dimensions are non-limiting, and a dispenser 10 may be constructed with other dimensions.

FIGS. 12A-12C illustrate a hexagonal dispenser 800 with a hexagon shaped outer shell 50 is shown in another embodiment of the invention. In such embodiment, the hexagonal dispenser 800 may include the following dimensions: (G) width of 18.00 inches, (H) length of 16.50 inches, and (I) height of 30.00 inches. It will be appreciated that such dimensions are non-limiting, and a dispenser 800 may be constructed with other dimensions.

FIGS. 13A-13C illustrate a round dispenser 810 with a round outer shell 50 in another embodiment of the invention. In such embodiment, the round dispenser 810 may include the following dimensions: (J) diameter of 19.00 inches and (K) height of 30.00 inches. It will be appreciated that such dimensions are non-limiting, and a dispenser 810 may be constructed with other dimensions.

Referring to FIGS. 14-17C, an alternative beverage dispenser 820 for dispensing of beverage containers 5 at an upper hopper 905 near a top of the dispenser 820 is shown in a 36-can top unload embodiment of the present invention. A plunger enclosure 910 is integrated with an outer shell 50 to enclose a plunging mechanism that permits lifting a container 5 to an upper dispensing area of the dispenser 820.

Figure 15:
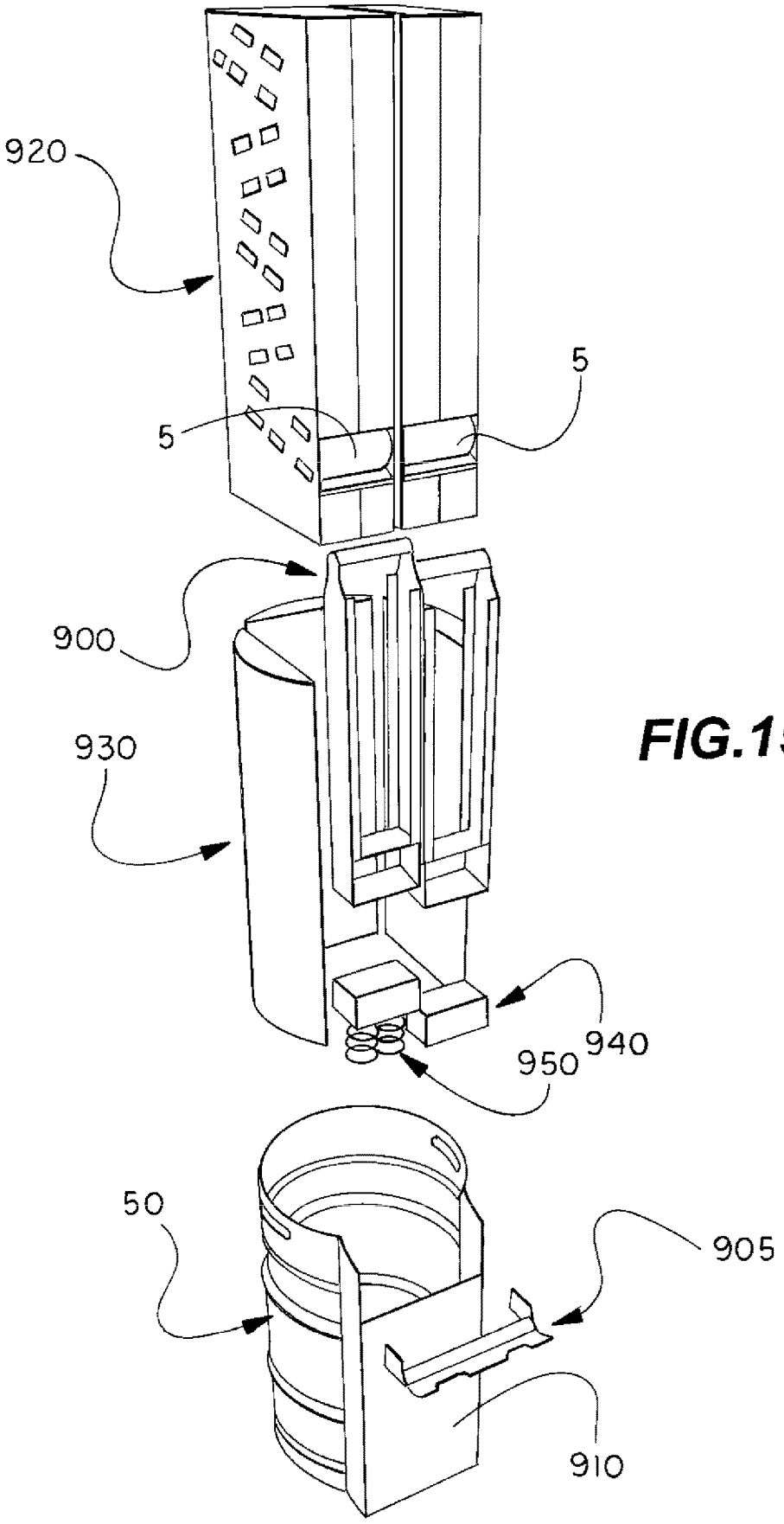
FIG. 15 is an exploded view of dual track assemblies, dual plungers, ice liners, blockers, blocker springs, outer shell and hopper of a beverage dispenser in a top unload embodiment of the present invention.
Figure 17A:
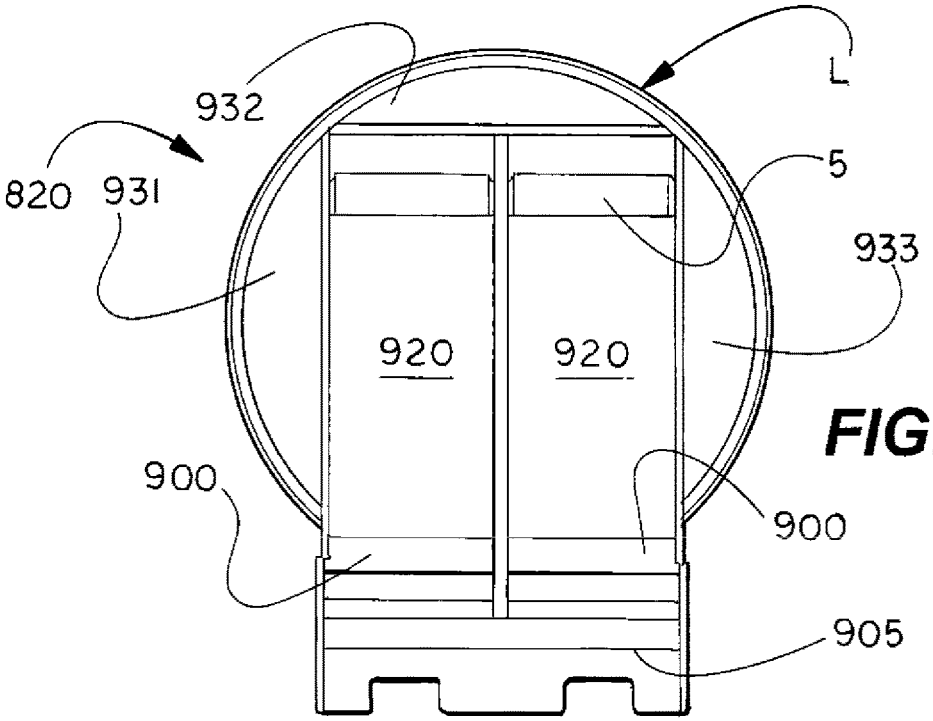
FIG. 17A is a top plan view of a beverage dispenser with dual tracks in a top unload embodiment of the present invention.

Referring to FIG. 15, dispenser 820 includes dual track assemblies 920 surrounded by three ice liners 930 that include liner openings 931, 932 and 933 (FIG. 17A). A pair of plungers 900, one for each track assembly 920, are positioned adjacent to a pair of blockers 940 and springs 950, such as 2 per blocker, below the blockers.

Figure 16A:
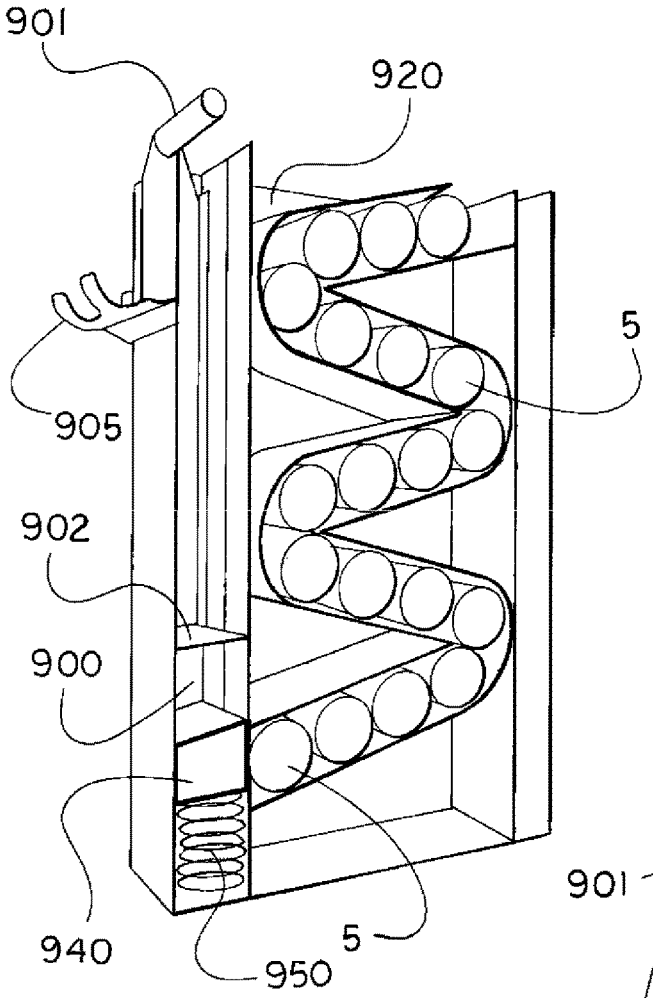
FIG. 16A-16C are internal perspective views illustrating operation of a plunger to dispense a beverage container at an upper hopper of a beverage dispenser in a top unload embodiment of the present invention.
Figure 16B:
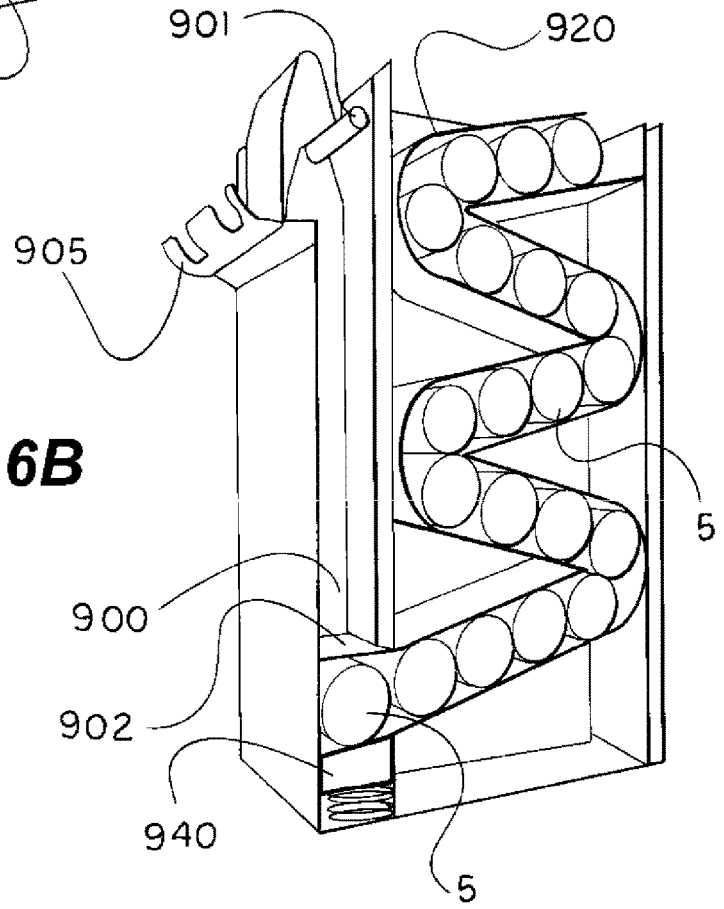
Figure 16C:
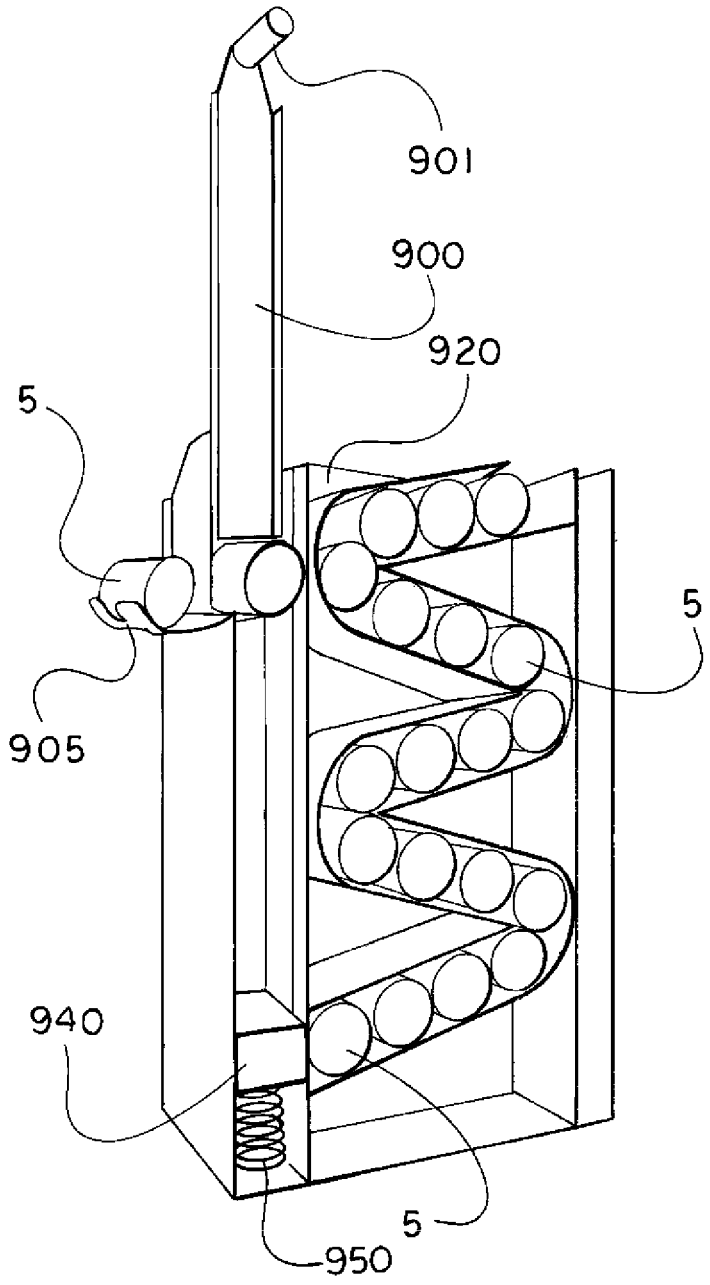

Referring to FIGS. 16A-16C, operation of the plungers 900 in a container 5 top unload embodiment of the invention is illustrated.

Referring to FIG. 16A, a plunger 900 is shown at rest position. One or more springs 950 hold a blocker 940 in place to retain beverage container 5 on the track assembly 920. The plunger 900 may include a handle 901. The blocker 900 may include a container retainer 902 to aid the plunger 900 in retaining a dispensed container as it is moved upward.

Referring to FIG. 16B, plunger 900 is shown in a container 5 load position. Pushing down on the plunger 900, such as by pushing on handle 901, pushes blocker 940 downward to compress springs 950 and allow a container 5 to load on to the plunger. In the depicted embodiment the retainer 902 assists to hold the container on the blocker 940 as it moves with the plunger.

Referring to FIG. 16C, plunger 900 is shown in a container 5 release position. Pulling up the plunger 900, such as by pulling on handle 901, pulls up the container 5 held on the plunger 900 to release on to the upper hopper 905 for dispensing. The plunger 900 may be released to fall back into the resting position shown in FIG. 16A.

Figure 17B:
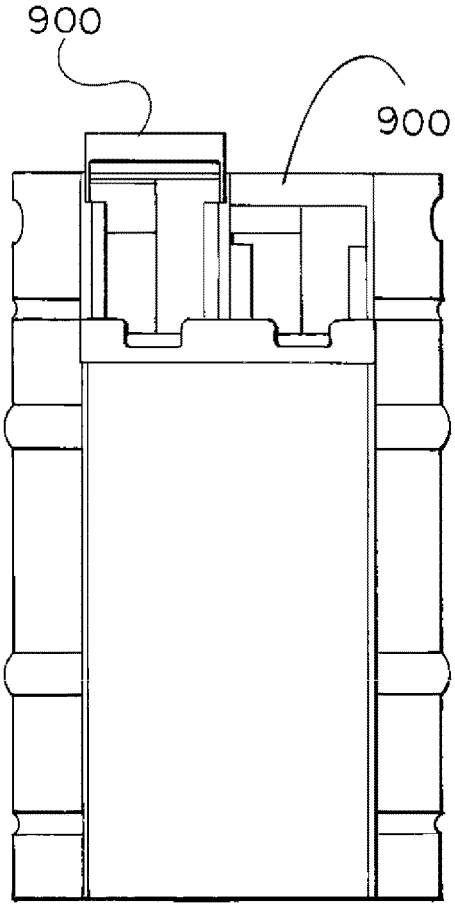
FIG. 17B is a front plan view of a beverage dispenser with dual tracks in a top unload embodiment of the present invention.
Figure 17C:
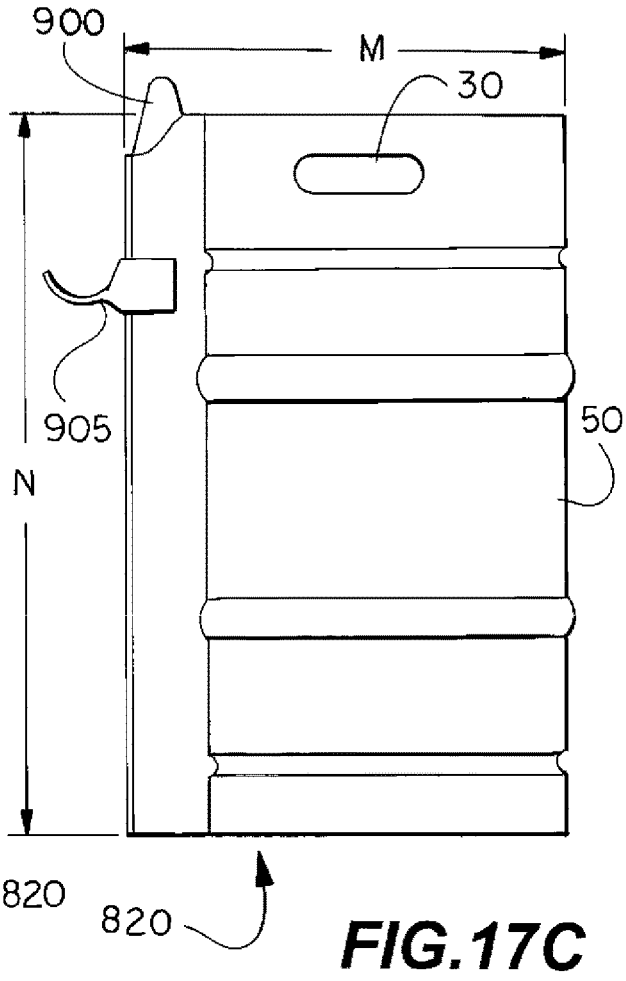
FIG. 17C is a side plan view of a beverage dispenser with dual tracks in a top unload embodiment of the present invention.

FIGS. 17A-17C illustrate dispenser 820 including plungers 900 in the upper dispensing embodiment of the invention. In such embodiment, the dispenser 820 may include the following dimensions: (L) diameter of 16.13 inches, (M) height of 26.88 inches and (N) width including plunger housing 905 of 16.69 inches. It will be appreciated that such dimensions are non-limiting, and a dispenser 820 may be constructed with other dimensions.

Various embodiments of the invention have been described. It will, however, be evident that various modifications and changes may be made thereto, and additional embodiments may be implemented, without departing from the broader scope of the exemplary embodiments as set forth in the claims. This specification is to be regarded in an illustrative rather than a restrictive sense.

What we claim is:

1. A beverage dispenser, comprising:

an outer shell having a top and bottom;

a water-resistant ice liner with a liner opening providing a hollow ice-holding space in a portion of and extending unobstructed from the top to the bottom of the outer shell;

an internal dual track assembly, each internal track of the internal dual track assembly comprising a descending and inclined ramp inside the outer shell and adjacent to the ice liner, wherein said ramp is shaped with multiple direction-reversing bends that avoids traversing the hollow ice-holding space; and a beverage container open dispensing area at a bottom end of the internal dual track assembly; and two rotatable rollers, one each located on the outer shell on opposite sides proximate the beverage container open dispensing area, and each coupled to one or more escapement holders such that turning either roller causes a beverage container to be moved into the beverage container open dispensing area.

2. The beverage dispenser of claim 1, wherein the outer shell is constructed of at least one of styrene and metal.

3. The beverage dispenser of claim 1, where the outer shell comprises a beer keg-type shape.

4. The beverage dispenser of claim 1, wherein the beverage container open dispensing area is configured to dispense beverage containers from the internal dual track assembly simultaneously based on turning either roller.

5. The beverage dispenser of claim 1, wherein the beverage container open dispensing area is configured to dispense beverage containers from the internal dual track assembly in an alternating manner from each track based on turning either roller.

6. The beverage dispenser of claim 1, further comprising:

a plurality of water-resistant liners and liner openings providing a plurality of hollow ice-holding spaces.

7. The beverage dispenser of claim 1, wherein the dispenser is portable and includes one or more handles.

8. The beverage dispenser of claim 1, wherein the internal dual track assembly has a capacity of 36 beverage containers.

9. A beverage dispenser, comprising:

an outer shell having a top and bottom;

a plurality of water-resistant ice liners, each with a liner opening providing a hollow ice-holding space in a portion of and extending unobstructed from the top to the bottom of the outer shell;

an internal track assembly, comprising four tracks, each internal track of the internal track assembly comprising a descending and inclined ramp inside the outer shell and adjacent to the ice liners, wherein said ramp is shaped with multiple direction-reversing bends that avoids traversing the hollow ice-holding space and the four tracks arranged in a configuration comprising two sets of dual tracks with one track stacked on top of the other in each dual track set; and a beverage container open dispensing area at a bottom end of the internal four track assembly.

10. The beverage dispenser of claim 9, wherein the plurality of water resistant ice liners comprises four ice liners.

11. The beverage dispenser of claim 9, wherein the outer shell is constructed of at least one of styrene and metal.

12. The beverage dispenser of claim 9, where the outer shell comprises a beer keg-type shape.

13. The beverage dispenser of claim 9, further comprising:

at least two rotatable rollers, each located on the outer shell proximate the beverage container open dispensing area and each rotatable roller coupled to one or more escapement holders;

an upper roller and a lower roller coupled through a system of gears to the one or more escapement holders and configured to be actuated by one of the at least two rotatable rollers.

14. The beverage dispenser of claim 9, wherein the beverage container open dispensing area is configured to dispense beverage containers from the internal track assembly simultaneously.

15. The beverage dispenser of claim 9, wherein the dispenser is portable and includes one or more handles.

16. The beverage dispenser of claim 9, wherein the internal four track assembly has a capacity of 48 beverage containers.

17. The beverage dispenser of claim 9, further comprising:

at least two rotatable rollers, each located on the outer shell proximate the beverage container open dispensing area and each rotatable roller coupled to one or more escapement holders such that turning either roller causes at least one beverage container to be moved into the beverage container open dispensing area.

18. The beverage dispenser of claim 17, further comprising:

an upper roller and a lower roller located on each side of the outer shell proximate the beverage container open dispensing area and configured such that each upper and lower roller is coupled to the one or more escapement holders and actuated by at least one of the at least two rotatable rollers.

* * * * *